United States Patent [19]

Strater et al.

[11] Patent Number: 5,031,869

[45] Date of Patent: Jul. 16, 1991

[54] CONTROL ASSEMBLY FOR CHAIR HEIGHT ADJUSTMENT

[75] Inventors: William H. Strater, Long Beach; Chane W. Lee, Harbor City, both of Calif.

[73] Assignee: Illinois Tool Works Inc., Glenview, Ill.

[21] Appl. No.: 46,410

[22] Filed: May 5, 1987

[51] Int. Cl.[5] ..... F16M 13/00

[52] U.S. Cl. ..... 248/406.1; 248/188.4; 297/348

[58] Field of Search ..... 248/406.1, 406.2, 188.4, 248/405; 297/348

[56] References Cited

U.S. PATENT DOCUMENTS

| | | | |
|---|---|---|---|
| 699,889 | 5/1902 | Morsell | 248/406.1 |
| 1,207,412 | 12/1916 | Keeney | 248/406.1 |
| 1,230,239 | 6/1917 | Travers | 248/406.1 |
| 1,270,350 | 6/1918 | Watkins | 248/406.1 |
| 1,589,847 | 6/1926 | Hansen | 248/406.1 X |
| 3.161,396 | 12/1964 | Anderson | 248/405 |
| 3,386,697 | 6/1968 | Helms | 248/406.1 |
| 3,711,054 | 1/1973 | Bauer | 248/562 |
| 3,741,514 | 6/1973 | Snurr | 297/345 X |
| 3,778,014 | 12/1973 | Driscoll et al. | 248/406.1 |
| 3,799,485 | 3/1974 | Wolters | 248/406.1 |
| 4,113,220 | 9/1978 | Godwin et al. | 248/566 |
| 4,261,540 | 4/1981 | Baker et al. | 248/406.2 |
| 4,493,469 | 1/1985 | Holobaugh | 248/406.1 |

*Primary Examiner*—David L. Talbott

[57] ABSTRACT

A displacement control assembly includes a rotatable lead screw longitudinally extending within a tubular column supporting the assembly. A nut is threaded to the screw for relative axial displacement of the screw and nut, for example, to adjust the height of a chair seat or similar fixture. A resilient brake structure is carried by either the nut or the screw for resiliently biased, alternative locking and unlocking of the nut and screw in order to selectively prevent relative rotation and relative axial displacement of the screw and nut. The releasable lock allows the screw and nut to co-rotate without relative axial displacement so that the chair seat can be swiveled without altering the desired height. The assembly can be designed with the parameters correlated so that the seat is lowered at uniform speed independent of the weight of the seat occupant.

22 Claims, 4 Drawing Sheets

12
56
2.
14
10
16
18
2.

56
14
20
38
16
42
44
46
38
40
22
4
4
24
30
26
34
28
36
32
32a 56
14
20
16
46
38
38
24

44
44
44
44
24

54
14
52
16
44
50
48
42
38
24
22
30
32

14
50
48
48
42
10
10
44
46
38
24
22

14
50
48
48
46
42
42
22
24

CONTROL ASSEMBLY FOR CHAIR HEIGHT ADJUSTMENT

BACKGROUND OF THE INVENTION

This invention relates to height or displacement adjustment mechanisms for chairs and similar fixtures, and more particularly relates to mechanisms for adjusting the height of chairs which are designed to swivel without altering the previously adjusted height of the chair seat.

In order to selectively adjust the height of a chair seat, tabletop or similar fixture, relative to the base of the fixture, numerous height adjustment mechanisms have been developed as described for example in U.S. Pat. Nos. 3,161,396; 3,711,054; 3,741,514 and 3,778,014. Since modern office chairs are designed to allow swiveling of the seat without modifying the height of the seat which the user wishes to maintain, the arrangement of the height adjustment mechanism must also enable such swiveling. In the height adjustment mechanisms for swiveling chairs, as described for example in U.S. Pat. Nos. 3,386,697 and 3,799,485, the threaded spindle is rotatably mounted in the chair base to enable swiveling of the height adjustment mechanism and the seat is supported on a column arranged for displacement with a spindle nut which can be threaded along the spindle to either elevate or lower the column and seat when a locking device has been activated to restrain rotation of the spindle. The mechanisms described in both of these patents require an inconvenient height adjustment operation performed by the user who must continuously lift and hold activating device with his foot in order to lock the spindle against rotation throughout the simultaneous operation of manually rotating the seat to accomplish the height adjustment. Both of these mechanisms also require detent interference between the nut and spindle which must be repeatedly overridden by the user's corresponding applications of intermittently increased torque on the seat in order to perform the height adjustment operation and the resulting height adjustment can only be obtained in the increments governed by the number and configuration of the detent formations. Mechanisms incorporating pressurized fluid drive for chair height adjustment have been developed and described, for example in U.S. Pat. Nos. 3,711,054 and 4,113,220. However, these mechanisms have been subject to failure in pressure seals and gas leakage. In the effort to improve the convenience of the height adjustment operation, the mechanism described in U.S. Pat. No. 4,493,469 incorporates a threaded screw and nut arrangement in which the screw and nut can be locked and unlocked using a system of locking bushings and a linkage therefor which is manually activated and deactivated. However, this mechanism requires a particularly large number of cooperating, movable components and allows height adjustment only in predetermined increments governed by the configuration of a locking bushing.

In the further effort to simplify the chair height adjustment operation, U.S. Pat. No. 4,261,540 describes a height adjustment mechanism in which height adjustment is automatically performed whenever the seat is unoccupied and rotated; the mechanism allows automatic disengagement of the height adjustment drive component whenever the seat is occupied, or otherwise weighted, so that the seat can be swiveled without altering the height. However, the automatic activation of the height adjustment drive produces undesired height adjustment whenever the unoccupied chair seat is rotated, for example when the user may be maneuvering the radial orientation of the unoccupied seat or relocating the entire chair. This mechanism does not include a rotatable screw and nut arrangement, but provides an entirely stationary, threaded sheet metal sleeve secured to the interior of the support column in the base of the chair; a threaded member is exteriorly threaded within the sheet metal liner to provide vertical adjustment of an unthreaded chair supporting spindle (shaft) to which the threaded member is releasably locked by a spring biased detent means when the chair is unoccupied. The unthreaded shaft is supported on the biasing spring so that when the chair is occupied the spring is compressed to automatically release the detent connection to the threaded member and the shaft swivels without height adjustment upon the compressed spring.

SUMMARY OF THE INVENTION

The displacement control assembly of the invention includes a rotatable lead screw longitudinally extending within a tubular column supporting the assembly. A nut is threaded to the screw for relative axial displacement of the screw and nut, for example, to adjust the height of a chair seat or similar fixture. A resilient brake structure is carried by either the nut or the screw for resiliently biased, alternative locking and unlocking of the nut and screw in order to selectively prevent relative rotation and relative axial displacement of the screw and nut.

In a preferred embodiment the nut is longitudinally displaceable along the screw and a tubular post which can support a chair seat is secured to and movable with the nut to provide an adjustably displaceable carriage. The brake structure includes a pair of resilient brake shoes which extend axially from the nut so that the screw is between the shoes. Each of the shoes includes a radially inwardly directed projection which is resiliently biased for frictional insertion within a corresponding axially aligned groove formed in the screw in order to releasably lock the nut onto the screw. The releasable lock allows the screw and nut to co-rotate without relative axial displacement so that the chair seat can be swiveled without altering the desired height

DETAILED DESCRIPTION OF THE ILLUSTRATED EMBODIMENTS

Figures 1, 2, 3, 4:
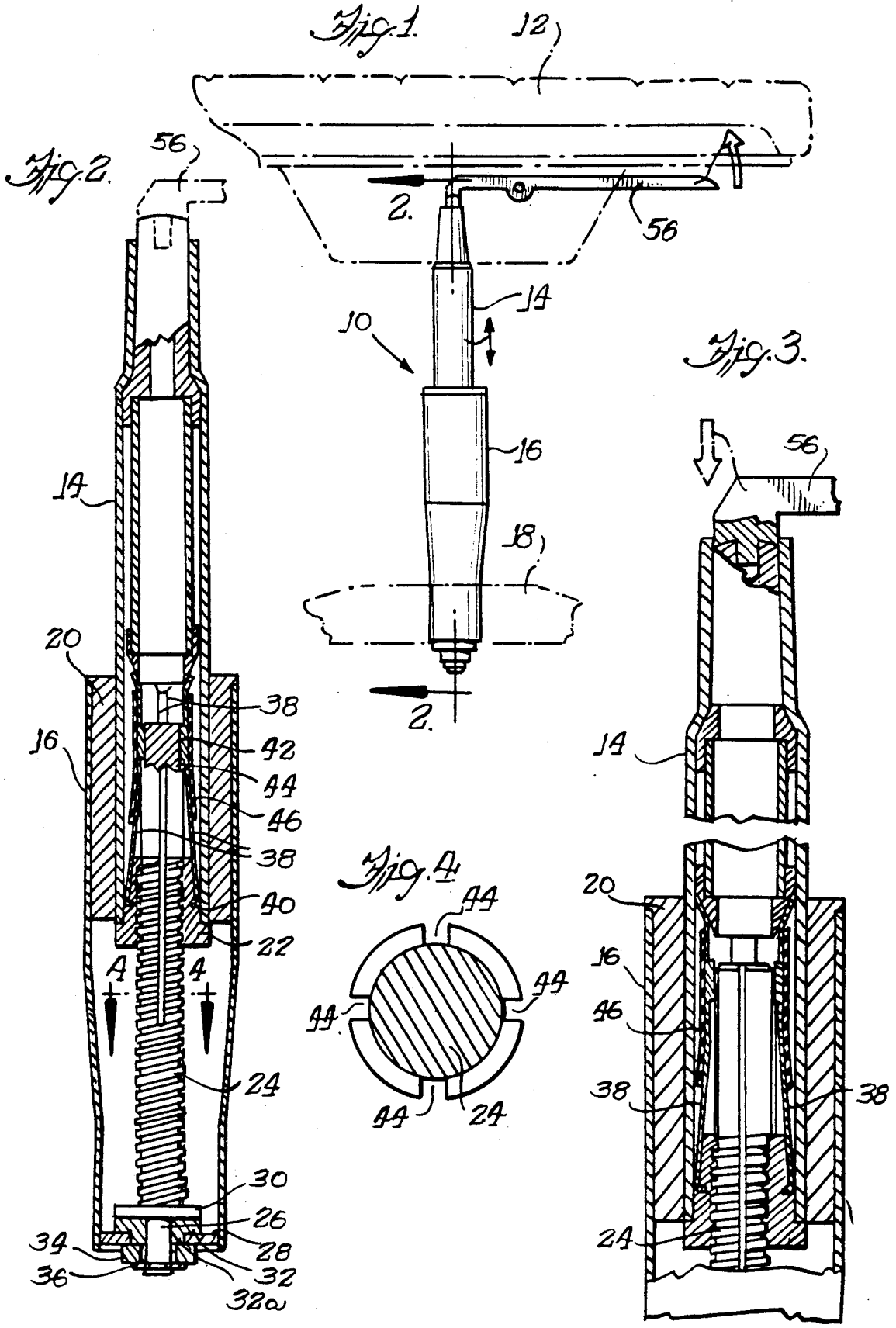
FIG. 1 is an elevation view of a displacement control assembly of the invention, illustrating installation of the assembly in a chair for adjusting the height of a seat shown in phantom.
FIG. 2 is a sectional view taken along the line 2—2 in FIG. 1 and viewed in the indicated direction, and illustrating the maximum elevation of the chair support column carried on a displaceable nut threaded on a supporting screw.
FIG. 3 is a sectional view similar to FIG. 2 and illustrating the released condition of a brake structure which selectively locks the nut and screw together.
FIG. 4 is a sectional view taken along line 4—4 in FIG. 2, viewed in the indicated direction and illustrating longitudinal grooves formed in the screw.

The following description of the embodiment of the height adjustment assembly in the drawings is an example of the invention, but does not indicate limitation upon the scope of the appended claims.

Referring to FIG. 1, a height adjustment assembly generally designated by reference character 10 supports a chair having a seat 12 (shown in phantom) which both swivels and adjusts to variable height.

The assembly 10 includes a tubular seat post 14 on which the seat 12 is secured; the post 14 is telescopically elevated and lowered within a tubular support column 16 mounted on a chair base 18 (shown in phantom).

As shown in FIG. 2, the seat post 14 travels in slideable engagement through a support bushing 20 within the upper portion of the column 16. The lower end of the seat post 14 is mounted on a peripheral, annular shoulder formed on an internally threaded, load-bearing nut 22. The nut 22 is threaded for displacement along an externally threaded, high-pitch lead screw which extends upright within the column 16. The screw 24 has an unthreaded shaft 26 with reduced diameter which forms the lower end of the screw 24 and is mounted into the base of the column 16 formed by a base plate 28. The unthreaded shaft 26 extends first through the central bore of a friction washer 30 which is tightly mounted (or cast in place) against the lower end of the threaded portion of the screw 24.

The washer 30 is normally supported on a friction washer 32 which has a central bore through which the shaft 26 extends. The friction washer 32 provides the bearing surface on which the friction washer 30 and the screw 24 are supported to enable controlled rotation of the screw 24 when the chair seat is lowered, as more fully described hereinafter. The washer 32 can be fabricated from suitable material providing limited friction such as polyoxymethylene, for example Delrin 100 supplied by E. I. DuPont. The washer 32 has a downwardly extending collar 32*a* which is inserted within a central bore of the base plate 28. The shaft 26 extends downwardly from the collar 32*a* through a low friction thrust washer 34, such as a ball or roller bearing washer, mounted below the collar 32*a* and the plate 28 and normally spaced therefrom by a very small clearance (not shown). Just below the thrust washer 34, the shaft 26 is grooved to receive a snap ring 36 or similar retainer to prevent any substantial axial motion of the screw 24. The thrust washer 34 reduces rotational friction on the screw 24 when the seat 12 is elevated as described hereinafter.

Figure 5:
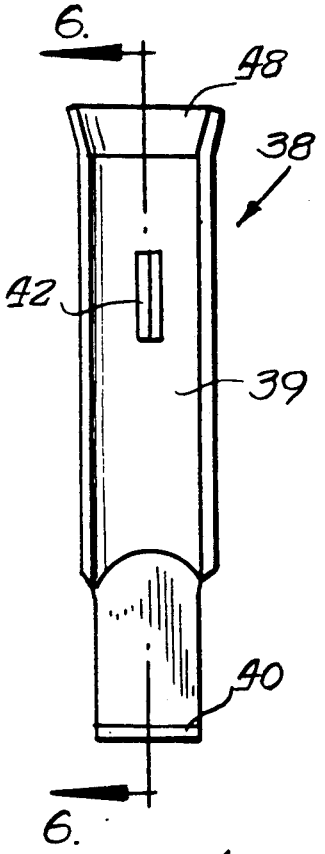
FIG. 5 is a plan view of one of the brake shoes shown in FIGS. 2 and 3 and illustrating a projection from the shoe which is selectively inserted within one of the screw grooves to lock the screw and nut together.
Figure 6:
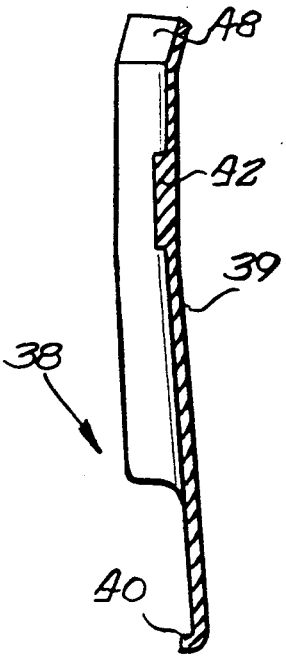
FIG. 6 is a sectional view taken along line 6—6 in FIG. 5 and viewed in the indicated direction.
Figures 7, 8, 9:
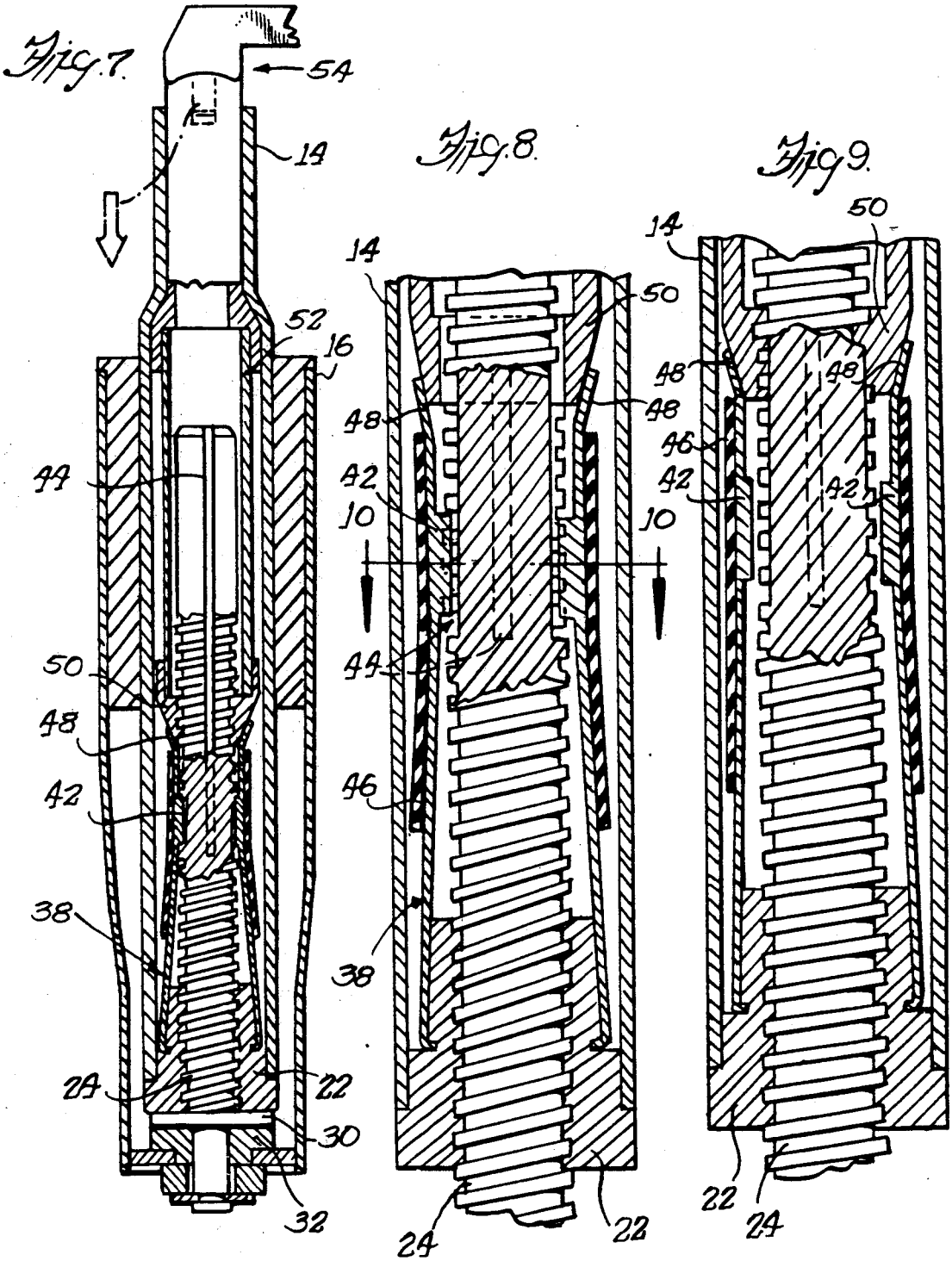
FIG. 7 is a sectional view similar to FIG. 2 and illustrating the lowest position of the nut and chair support post.
FIG. 8 is an enlarged sectional view of the locked position of the brake shoes and projections shown in FIG. 7.
FIG. 9 is a sectional view similar to FIG. 8 illustrating the brake shoe projections withdrawn from the screw grooves in the unlocked position of the brake shoes.

In order to prevent relative rotation between the screw 24 and nut 22 so that the screw and nut will rotate together when the seat 12 and post 14 are swiveled without alteration of the height of the seat or any longitudinal displacement of the nut, a pair of semi-conical brake shoes 38, whose configuration is best shown in FIGS. 5 and 6, extend upwardly from the nut 22 adjacent the interior surface of the post 4, as shown in FIGS. 2 and 3. Each of the shoes 38 has a radially inwardly extending foot 40 which is mounted in a corresponding one of a pair of opposing peripheral grooves formed in the upwardly extending surface of the nut 22. Each shoe 38 also includes a radially inwardly extending narrow projection 42 from the medial body 39 of the shoe 38. The proJection 42 is removably press-fitted into one of a pair of opposingly aligned longitudinal grooves 44 which extend through the threading of the screw 22 as best shown in FIGS. 4 and 7. (For convenience in aligning and reinserting the projections, one or more additional pairs of opposing grooves can be provided in the screw thread, as shown at right angle to the grooves 44 in FIGS. 4 and 7).

The brake shoes 38 are fabricated so that they are generally longitudinally rigid but radially resilient at least at the medial portion 39; the projections 42 are resiliently displaceable for insertion into the grooves 44 when the screw 24 and nut 22 are locked together and co-rotated to allow free swiveling of the post 14 and seat 12. However, when the seat height is adjusted, the projections 42 are resiliently withdrawn from the grooves 44 by radial outward displacement or pivot of the projections 42 about the feet 40 secured on the nut 22, as shown in FIG. 3.

In order to enable the radial motion of the projections 42, the shoes 38 are fabricated from suitably resilient material, such as thin steel from which the projections 42 can be simply punched. The projections 42 and the adjacent medial portions 39 of the shoes 38 are inwardly biased to the locking position inserted within the grooves 44 by a tubular, elastomeric sleeve 46 which circumferentially engages the outer surface of the medial portions of both brake shoes 38 in order to provide biasing inward pressure thereon.

In order to enable the withdrawal of the projections 42 from the grooves 44, each of the shoes 38 has a generally semi-conical upper end 48 as shown in FIGS. 5 and 6, which are aligned in radial opposition as best shown in FIGS. 7-9.

Referring to FIGS. 7 and 8, a conically-shaped, tubular cam member 50 is normally seated against both of the shoe ends 48 without exerting pressure thereon when the shoe projections 42 are inserted within the screw grooves 44 to allow the free swiveling of post 14 and seat 12. The cam 50 is mounted on the lower end of a tubular push rod 52 which is slideably mounted within the post 14, and forms part of a manually activated release linkage 54. As shown in FIG. 1, the linkage 54 is raised and lowered by a manual lever 56. Referring to FIG. 7 when the seat height has been adjusted to the minimum useful level so that the nut 22 has been lowered to seat on the washer 30, the screw 24 can extend, through the central bores of both the tubular cam 50 and push rod 52.

Referring to FIG. 9, when the seat height adjustment operation is performed to either elevate or lower the seat, the shoe projections 42 are withdrawn from the screw grooves by manually depressing the linkage 54 to displace the cam 50 downwardly which forces apart the engaged shoe ends 48 and medial portions 39 overcoming the bias of the elastomeric sleeve 46; the outwardly withdrawn projections 42 will then clear the thread on the screw 24. The resulting unlocking of projections 42 from the screw 24 allows relative rotation of the nut 22 for the seat height adjustment. The seat is elevated by simply pulling upward on the seat and the nut 22 connected thereto, neither of which require rotation because the upward force by the nut on the screw thread is transmitted to rotate the screw; pulling upward on the seat 12 also slightly elevates the screw 24 so that the friction washer 30 disengages from the friction washer 32 and the slight upward displacement brings the ball thrust washer 34 into engagement with the lower surface of the base plate 28 to enable minimal frictional resistance to the rotation of the screw 24.

As shown in FIGS. 3 and 7, the grooves 44 extend to the top of the screw 24 which defines the upper limit of the useful stroke length of the post 14 and the maximum seat height. The projections 42 can be reinserted at any point along the length of the grooves 44 by manually operating the linkage 54 to upwardly retract the cam 50 relative to the shoe ends 48 allowing the inward displacement of the projections to again lock the screw 24 and nut 22 for co-rotation and seat swivel at the desired seat height.

In order to lower the seat 12 after manually displacing the cam 50 to withdraw the projections 42 from the grooves 44, it is only necessary for the user to push downwardly on the seat without requiring rotation since the downward force transmitted by the nut 22 to the screw thread will drive rotation of the screw 24 moderated by the relative rotation of the friction washers 30 and 32. When the nut 22 and seat 12 have been downwardly displaced to the desired seat height, the cam 50 can be manually retracted to enable reinsertion of the projections 42 in the screw grooves 44 locking the screw 24 and nut 22 for swiveled co-rotation. Because the projections 42 can be inserted or withdrawn at any point along the length of the screw grooves 44, the seat height adjustment can be performed in a smoothly continuous manner without any limitation by predetermined increments of displacement, and the resilience of the brake structure enables reliable, uncomplicated height adjustment operation by the user.

In a particularly preferred aspect, the control assembly of the invention can be designed to enable the chair seat to descend at a controlled, substantially constant speed independent of the weight of the particular seat occupant. In such design the rotational resistance imposed by the thrust bearing on the screw (e.g. the friction between washers 30 and 32) can be coordinated with the rotational resistance imposed on the inclined surface of the screw thread by the rotationally stationary, descending nut so that the occupied chair seat will be lowered without variation by the occupant's weight. This design requires correlation of the coefficient of sliding friction at the threaded interface of the screw and nut ($\mu_1$) and the coefficient of sliding friction at the interface of the screw and thrust bearing ($\mu_2$) with the lead angle ($\alpha$) of the screw. When the materials are selected for the screw, nut and thrust bearing, the correct lead angle ($\alpha$) of the screw can be determined from the following correlations which apply when the weight of the screw itself is a negligible percent of the combined total weight (F) of the chair occupant and all of the chair seat components which are supported on the nut.

Figure 12:
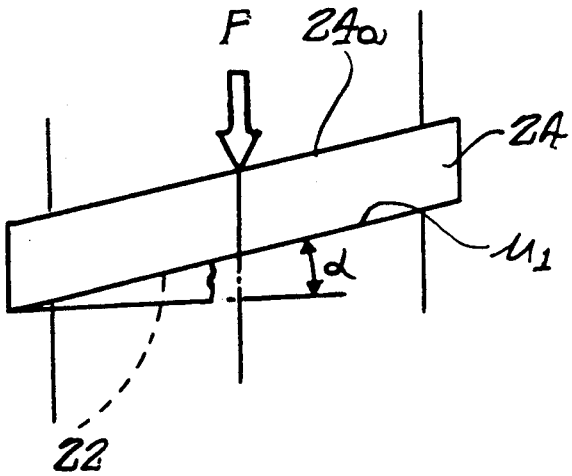
FIG. 12 is a diagrammatic illustration of the screw thread and lead angle of the assembly in FIGS. 2 and 3.
Figure 12A:
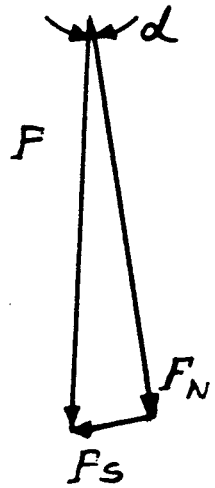
FIG. 12*a* is a diagrammatic illustration of the force components on the screw thread of FIG. 12.

Referring to FIGS. 12 and 12a

$$F = F_n + F_s$$

where $F_n$ is the force component of F which is normal to the surface of the screw thread 24a and $F_s$ is the force component of F parallel to and along the screw thread:

$$/F_n/ = /F/ \times COS\alpha$$

and $$/F_s/ = /F/ \times Sin\alpha$$

The torque forces along the screw thread are:

$$\begin{aligned} T_{Fs} &= F_s \times \text{moment arm} \\ &= /F/\text{Sin}\alpha \times 1/2\ TD \end{aligned}$$

where TD is the screw thread diameter; and the frictional torque, $$\begin{aligned} T_{fr} &= \mu_1 F_n \times \text{moment arm} \\ &= \mu_1 /F/\text{COS}\alpha \times 1/2\ TD \end{aligned}$$

When the screw thread descends at generally uniform rotational speed $T_{Fs}$ is equal or larger than $T_{fr}$ or $$T_{Fs} \geqq T_{fr}$$

and substituting $$/F/\text{Sin}\alpha \times \tfrac{1}{2}(\text{TD}) \geqq \mu_1 F\ \text{COS}\alpha \times \tfrac{1}{2}(\text{TD})$$

(1) and $$\text{and } \mu_1 \leqq \frac{\text{Sin } \alpha}{\text{COS } \alpha} = \tan\alpha \qquad (1)$$

Figure 13:
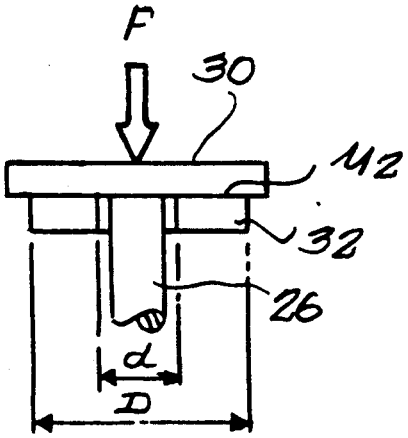
FIG. 13 is a diagrammatic illustration of the load force on the thrust bearing of FIGS. 2 and 7.
Figure 13A:
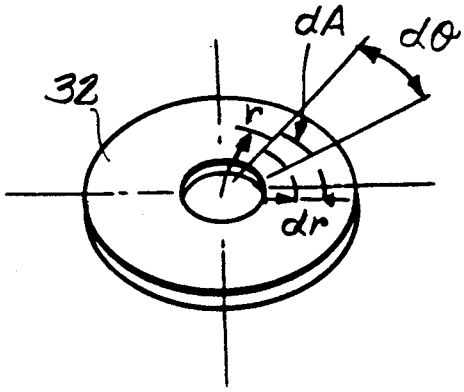
FIG. 13*a* is a diagrammatic illustration of descriptive geometry of the surface of the thrust bearing in FIG. 13.

Referring to FIGS. 13, 12 and 12a, the component of $F_s$ which drives rotation of the screw about its longitudinal axis against the thrust bearing is $$T_{Dr} = F_s\ \text{COS}\alpha = F\text{Sin}\alpha\ \text{COS}\alpha = \frac{F\ \text{Sin } 2\alpha}{2}$$

The driving torque is opposed by two frictional torques:

(a) a component of the frictional torque on the screw thread $T_{fr}$ which is $$T_{fr}(\mathrm{COS}\alpha) = \mu_1 F\,\mathrm{COS}\alpha(\mathrm{COS}\alpha) = \mu_1 F\,\mathrm{COS}^2\alpha$$

and (b) the frictional torque at the interface of the screw and the thrust bearing is $$\tau_{fr}=F\mu_2 r$$

where $\mu_2$ is the effective coefficient of friction at the thrust bearing and r is the effective moment arm.

At uniform rotational speed of the screw upon the thrust bearing the torques are summed as follows:

$$T_{Dr}-T_{fr}-\tau_{fr}=0$$

or $$\frac{TD}{2}\times F\frac{\mathrm{Sin}\,2\alpha}{2}-\frac{TD}{2}\times\mu_1 F\,\mathrm{COS}^2\alpha-F\mu_2 r=0$$

Eliminating F and rearranging, the second design equation is $$\frac{\mathrm{Sin}\,2\alpha}{2}-\mu_1\mathrm{COS}^2\alpha=\frac{2\mu_2 r}{TD}$$

which can be solved by iterative methods so that uniform lowering speed of the seat, independent of the weight of the occupant, can be achieved by correct selection of the correlated design parameters.

When the thrust bearing is an anti-friction washer 32 as in FIGS. 2, 7, 13A and 13, the thrust bearing frictional torque is $$\int d\tau_{fr}=\mu_2\sigma r^2 d\sigma dr=\int\frac{4F\mu_2}{\pi}\;\frac{r^2}{(D^2-d^2)}\,d\sigma dr$$

$$\tau_{fr}=\frac{4F\mu_2}{(D^2-d^2)\pi}\int_d^D\int_o^{2\pi} r^2\,d\sigma\,dr$$

$$=\frac{4F\mu_2}{(D^2-d^2)\pi}(2\pi)\int_d^D r^2\,dr$$

$$=\frac{8F\mu_2}{D^2-d^2}\;\frac{D^3-d^3}{3}$$

$$=\frac{8F\mu_2}{3}\;\frac{(D-d)(D^2+Dd+d^2)}{(D+d)(D-d)}$$

$$=\frac{8F\mu_2}{3}\;\frac{D^2+Dd+d^2}{D+d}$$

In this embodiment the torque summation is $$T_{Dr}-T_{fr}-\tau_{fr}=0$$

or $$\frac{TD}{2}\times F\frac{\mathrm{Sin}\,2\alpha}{2}-\frac{TD}{2}\times\mu_1 F\,\mathrm{COS}^2\alpha-\frac{8}{3}\mu_2 F\frac{D^2+Dd+d^2}{D+d}=0$$

and eliminating F:

$$\frac{TD}{2}\left[\frac{\mathrm{Sin}\,2\alpha}{2}-\mu_1\mathrm{COS}^2\alpha\right]-\frac{8}{3}\mu_2\frac{D^2+Dd+d^2}{D+d}=0$$

and the equation is rearranged and expressed by $$\frac{\mathrm{Sin}\,2\alpha}{2}-\mu_1\mathrm{COS}^2\alpha=\frac{16}{3}\;\frac{\mu_2}{TD}\;\frac{D^2+Dd+d^2}{D+d}$$

In an example of the application of the design equation, a zinc screw 24 and a Delrin® AF nut 22 were employed with a hardened steel washer 30 against a Teflon® bearing washer 32 so that $\mu_1$ had a value of 0.08 and $\mu_2$ had a value of 0.04. The bearing washer 32 had an inner diameter d equal to 0.324 inch and an outer diameter D equal to 0.75 inch. The screw had a thread diameter equal to 7/16 inch. Numerical substitution into the final equation is as follows:

$$\frac{7/16}{2}\left[\frac{\mathrm{Sin}\,2\alpha}{2}-0.08\,\mathrm{COS}^2\alpha\right]-0.04\,\frac{8}{3}\;\frac{.75^2+(.75)(.324)+(.324)^2}{.75+.324}=0$$

Reducing to:

$$=>=\frac{\mathrm{Sin}\,2\alpha}{2}-0.08\,\mathrm{COS}^2\alpha=.413375$$

iterative solution results in $\alpha=20°$.

Figure 11:
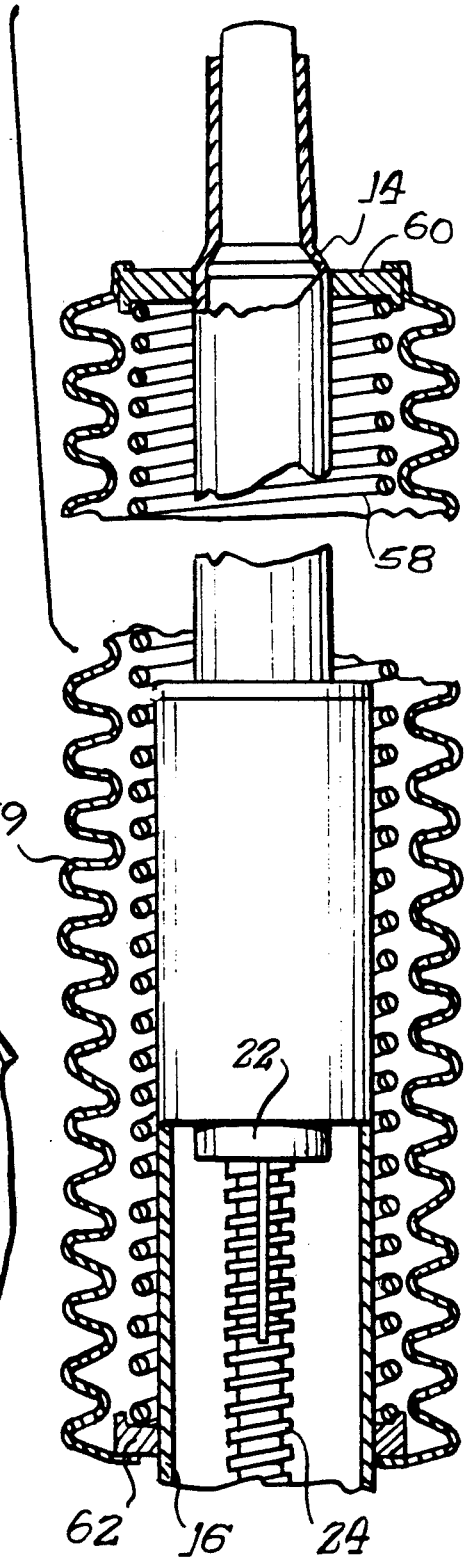
FIG. 11 is a partial sectional view of a modified assembly of the invention illustrating a return spring which assists elevation of the seat support post.
Figure 10:
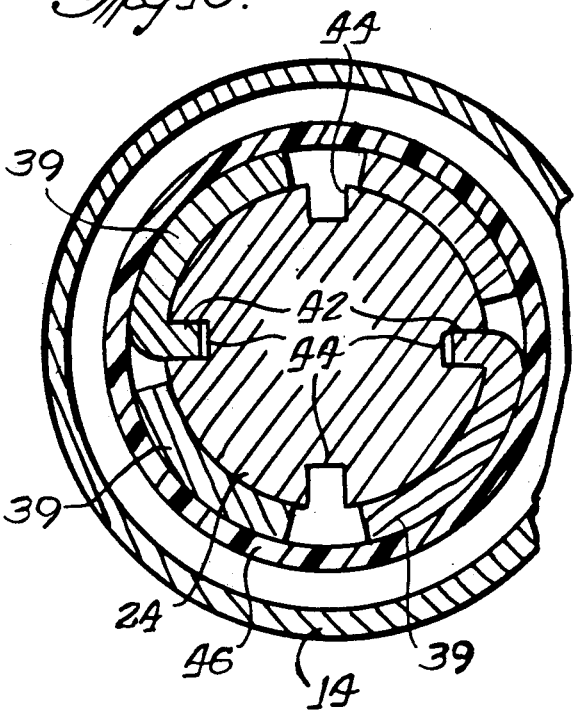
FIG. 10 is a sectional view taken along line 10—10 in FIG. 8 and viewed in the indicated direction, illustrating the locked position of the brake shoe projections inserted within the screw grooves.

Modifications of the illustrated embodiment of the displacement control assembly of the invention will be apparent to those skilled in the art and are within the broad scope of the appended claims. For example, referring to FIG. 11, the elevation of the seat can be assisted by providing a compressible spring 58 (and optional bellows cover 59) to impose upwardly directed force on the seat post 14 relative to the support column 16 and providing respective flanges 60 and 62 on which the ends of the spring 58 and the cover 59 are seated. Additional modifications can be made, for example, in substituting for the elastomeric sleeve 46 a metallic or similar spring having a configuration suitably promoting the inward bias of the brake shoes. Another modification can be made in substituting for the brake shoe projections a frictional device imposing sufficient locking resistance between the screw and the brake shoes Optionally, the resilient brake shoes can be mounted on the screw for releasable locking engagement with the nut.

The invention is claimed as follows:

1. A control assembly for adjustable displacement of a chair seat or the like, comprising: a tubular column for supporting the assembly; a continuously rotatable lead screw longitudinally extending within said column; a nut threaded to and longitudinally displaceable along said screw; a tubular post secured to and movable with said nut for carriage and adjustable displacement of said chair seat therewith; and a resilient brake structure carried on said nut for resiliently biased, alternative engagement with and retraction from said screw, to selectively prevent relative rotation of said screw and nut thereby locking said post and nut on the screw and preventing axial displacement of the post relative to the screw, swivel means for enabling corotation of said locked screw, nut and post, said brake structure comprises at least one brake shoe means for normally biased engagement with said screw, and release means for selectively withdrawing said shoe means from said screw in opposition to said bias, thereby unlocking said nut from the screw to enable relative rotation therebetween and displacement of said post with the nut, said release means including manually operable linkage means extending within said tubular column and downwardly from the upper end of said tubular column for axial movement along said tubular column to permit selective withdrawing of said shoe means.

2. The assembly of claim 1 wherein said brake structure further comprises spring means for pressured engagement with said shoe means for promoting said biased engagement of said screw.

3. The assembly of claim 2 wherein said spring means comprises an elastomeric member.

4. A control assembly for adjustable displacement of a chair rest or the like, comprising: a tubular column for supporting the assembly; a rotatable lead screw longitudinally extending within said column; a nut threaded to and longitudinally displaceable along said screw; a tubular post secured to and movable with said nut for carriage and adjustable displacement of said chair seat therewith; and a resilient brake structure carried on said nut for resiliently biased, alternative engagement with and retraction from said screw, to selectively prevent relative rotation of said screw and nut thereby locking said post and nut on the screw and preventing axial displacement of the post relative to the screw; said brake structure comprises at least one brake shoe means for normally biased engagement with said screw, said shoe means comprises a pair of elongate shoe members axially projecting from said nut in opposing relation, and wherein said screw is located between said shoe members.

5. The assembly of claim 4 wherein each of said shoe members includes a radially inwardly projecting foot secured within a corresponding groove formed in the peripheral surface of said nut.

6. The assembly of claim 4 wherein each of said shoe members includes a medial portion thereof having an axially elongate, radially inwardly extending projection frictionally inserted within a corresponding axially aligned groove formed in the screw.

7. The assembly of claim 4 further comprising release means for selectively withdrawing said projections from said respective screw grooves in opposition to said bias, thereby unlocking said nut from the screw to enable relative rotation therebetween and displacement of said post with the nut.

8. The assembly of claim 7 wherein each of said shoe members includes a generally semi-conical end formed thereon, said ends being located in opposing radial alignment.

9. The assembly of claim 8 wherein said release means comprises a conically shaped cam member inserted between said ends and selectively movable to force said ends radially apart thereby forcing said withdrawal of said shoe projections from said screw grooves.

10. The assembly of claim 9 wherein said brake structure further comprises spring means for biasing said insertion of said shoe projections within said screw grooves.

11. The assembly of claim 10 wherein said spring means comprises a tubular, elastomeric sleeve in circumferentially surrounding engagement with said shoe members, exerting radially inwardly directed pressure thereon to promote said bias.

12. The assembly of claim 9 wherein said release means further comprises manually operable linkage means for activating said selective cam insertion.

13. The assembly of claim 12 wherein said linkage means comprises a push rod on which said cam is mounted.

14. The assembly of claim 13 wherein said push rod comprises a tube having said cam mounted on one end thereof, said tube being movably mounted and extending axially within said post.

15. A control assembly for adjustable displacement of a chair seat or the like, comprising: a tubular column supporting the assembly; a continuously rotatable lead screw longitudinally extending within said column; a nut threaded to said screw for relative axial displacement with respect thereto; a resilient brake structure carried by one of said nut and screw for resiliently biased, alternative unlocking and locking of the nut and the screw in order to selectively prevent relative rotation of the screw and nut thereby preventing relative axial displacement of the nut and screw, swivel means for enabling corotation of said locked nut and screw, said brake structure comprises at least one brake shoe means for normally biased locking of said nut and screw, said brake structure further comprises spring means for promoting said biased locking of said nut and screw, and release means for selectively unlocking said screw and nut in opposition to said bias, to enable relative rotation and relative axial displacement of the screw and nut, said release means including manually operable linkage means extending within said tubular column and downwardly from the upper end of said tubular column for axial movement along said tubular column to permit selective withdrawing of said shoe means.

16. The assembly of claim 15 wherein said nut is longitudinally displaceable along said screw.

17. The assembly of claim 16 further comprising a tubular post secured to and movable with said nut for carriage and adjustable displacement of said chair weight seat therewith.

18. The assembly of claim 17 wherein said brake structure is carried on said nut for resiliently biased alternative engagement with and retraction from said screw, to selectively lock said post and said nut on the screw and to prevent axial displacement of the post relative to the screw.

19. A control assembly for adjustable displacement of a chair seat or the like on which an applied load is supported, comprising a rotatable lead screw including lead angle and a nut threaded to and vertically displaceable along said screw, a support structure secured to and vertically movable with said nut for carriage of said seat, a thrust bearing means for supporting the rotation of said screw thereon, wherein said lead angle is selected to enable the torque forces along the screw thread to be equal to or greater than the frictional torque forces generated by said thrust, bearing means and thereby cause said nut and support structure to vertically descend along said rotating screw at uniform speed independent of the weight of the chair seat and independent of said applied load.

20. The control assembly according to claim 19 wherein said screw is rotatably engaged against said thrust bearing means during said descent and wherein said lead angle is defined by the following correlation:

$$\frac{\sin 2\alpha}{2} - \mu_1 \cos^2\alpha = \frac{2\mu_2 r}{TD}$$

where $\mu_1 \leqq \tan \alpha$;

where $\alpha$ is the lead angle; TD is the screw thread diameter; $\mu_1$ is the coefficient of sliding friction between the screw and nut;

$\mu_2$ is the effective coefficient of sliding friction between the screw and the thrust bearing; and r is the effective moment arm of the thrust bearing.

21. The control assembly according to claim 19 wherein said screw is rotatably engaged during said descent against said thrust bearing means having an annular bearing surface, and wherein said lead angle is defined by the following correlation:

$$\frac{\sin 2\alpha}{2} - \mu_1 \cos^2\alpha = \frac{16\,\mu_2}{3\,TD}\;\frac{D^2 + Dd + d^2}{D + d}$$

where $\mu_1 \leqq \tan \alpha$;

$\alpha$ is the lead angle;

$\mu_1$ is the coefficient of sliding friction between the screw and nut;

$\mu_2$ is the coefficient of sliding friction between the screw and the annular bearing surface;

D is the outer diameter of the annular bearing surface;

d is the inner diameter of the annular bearing surface, and

TD is the screw thread diameter.

22. The control assembly according to claim 21 wherein said screw includes a bearing washer fixed thereon and rotatably engaged against said annular bearing surface.

* * * * *